United States Patent [19]

Yunan

[11] 4,429,632

[45] Feb. 7, 1984

[54] DELAY DETONATOR

[75] Inventor: Malak E. Yunan, Boonton Township, Morris County, N.J.

[73] Assignee: E. I. Du Pont de Nemours & Co., Wilmington, Del.

[21] Appl. No.: 257,974

[22] Filed: Apr. 27, 1981

[51] Int. Cl.[3] ..... C06C 7/00; F42C 19/10; F42C 19/12

[52] U.S. Cl. ..... 102/202.13; 102/202.5; 102/204

[58] Field of Search ..... 102/202.13, 202.7, 202.5, 102/204, 200, 275.3, 275.6, 275.9, 275.11, 318, 322; 149/27

[56] References Cited

U.S. PATENT DOCUMENTS

| | | | |
|---|---|---|---|
| 1,928,206 | 9/1933 | Large | 102/202.11 |
| 2,268,372 | 12/1941 | Burrows | 149/27 |
| 2,761,386 | 9/1956 | Zebree | 102/202.13 |
| 2,773,447 | 12/1956 | Hall et al. | 102/202.11 |
| 2,878,752 | 3/1959 | Johnson et al. | 102/202.13 |
| 2,991,714 | 7/1961 | Noddin | 102/275.9 |
| 2,999,460 | 9/1961 | Stinger et al. | 102/28 |
| 3,021,786 | 2/1962 | Miller et al. | 102/27 |
| 3,158,097 | 11/1964 | Brockway et al. | 102/202.13 |
| 3,173,367 | 3/1965 | Shinpaugh | 102/202.13 |
| 3,188,914 | 6/1965 | Dahl | 102/202.14 |
| 3,286,628 | 11/1966 | Young et al. | 102/202.13 |
| 3,556,009 | 1/1971 | Thatcher | 102/202.13 |
| 3,587,467 | 6/1971 | Menke | 102/202.13 |
| 3,709,149 | 2/1962 | Miller et al. | 102/27 |
| 4,335,652 | 6/1982 | Bryan | 102/202.1 |

OTHER PUBLICATIONS

Co-pending U.S. patent application Ser. No. 77,718, filed 9/21/79.

Co-pending U.S. patent application Ser. No. 177,210, filed 8/11/80.

*Primary Examiner*—Richard E. Schafer
*Assistant Examiner*—Ted L. Parr
*Attorney, Agent, or Firm*—Diamond C. Ascani

[57] ABSTRACT

Improved uniformity of timing, and particularly reduced sensitivity of timing to minor variations in delay charge size, are achieved in delay detonators by placing a loose load of a flame-sensitive ignition composition between a pressed delay charge and an ignition assembly, e.g., a percussion primer, at the actuation end of the detonator. The loose ignition charge has a free surface and is adapted to be ignited in response to direct contact with flame emitted from the ignition of a charge in the ignition assembly. Preferably, the delay charge is pressed into a plastic carrier which, in a non-electric detonator, has an open end terminating between the walls of the detonator shell and a primer shell that closes the actuation end of the detonator, and the ignition charge is loosely loaded into a metal capsule seated against the delay charge.

18 Claims, 2 Drawing Figures

DELAY DETONATOR

BACKGROUND OF THE INVENTION

1. Field of the Invention

The present invention relates to a delay detonator, and more especially to a detonator adapted to be used in millisecond delay blasting.

2. Description of the Prior Art

The art of delay blasting is practiced widely in underground and open-work blasting operations as a means of improving rock fragmentation and displacement; providing greater control of vibration, noise, and fly rock; reducing the powder factor; and reducing blasting costs. Short-interval or millisecond-delay detonators (e.g., detonators having nominal delay times of no greater than about 1000 milliseconds) and long-interval delay detonators (e.g., those having nominal delay times of greater than about 1000 milliseconds) have been designed around the needs of different blasting requirements. At the present time, millisecond (MS) delays are the most widely used delay detonators for quarry, open-bit, and construction projects, and they are also used in underground mines for multiple-row slabbing blasts, stope blasts, and other production blasts where rows of holes are breaking to a free face. Typically, MS delay blasts will move rock farther away from the face than long-interval delay blasts because of the interaction between successive boreholes fired at the shorter delay intervals. The nominal time interval between periods of successive detonators in an available series often is as low as 25 milliseconds for lower-delay-period MS detonators, although it can be up to 100 milliseconds for higher-delay-period MS detonators, and up to about 500–600 milliseconds for long-interval delay detonators.

An important prerequisite to successful delay, especially MS delay, blasting is that the delay times of a number of detonators of stated delay rating be as uniform as possible from detonator to detonator. Desirably, the variation from the nominal value of the delay times of a given group of detonators of assigned nominal delay time should be small enough that no less than 8 ms elapse between the firing of detonators of any two consecutive periods. This would mean a maximum variation of ±8 ms for detonators in the 25-ms; ±21 ms for those in the 50-ms; and ±46 ms for those in the 100-ms interval series. Without good uniformity, it is difficult to achieve a desired fragmentation, vibration reduction, etc. as expected from a given delay pattern.

In delay detonators, the delay interval, i.e., the time between the application of electrical or percussive energy and the detonation, is provided by the interposition of a delay charge of an exothermic-burning composition between the ignition system and the priming charge of heat-sensitive detonating explosive. The burning rate of the delay composition and the length of its column determine the delay interval. While in some detonators the delay charge is pressed, without any surrounding element, directly into the detonator shell over the primer charge, usually the delay charge is housed within a heavy-walled rigid carrier tube, e.g., as shown in U.S. Pat. Nos. 2,999,460 (FIG. 1) and 3,021,786 (FIG. 2), or in a special plastic capsule or tube as is shown in co-pending U.S. patent application Ser. No. 77,718, filed Sept. 21, 1979. The latter shows that a polyolefin or polyfluorocarbon carrier for a delay charge is advantageous in that it reduces the variability of the delay timing with changes in the surrounding temperature or medium (e.g., air vs. water).

A shorter delay interval can be provided by reducing the length of a given delay charge or using a faster-burning composition. If it is desired to produce shorter delays without resorting to changing the delay composition, uniformity of delay timing may become difficult to achieve to a degree dependent somewhat on the internal structure of the detonator and the manner in which its delay element is produced. This difficulty arises because inaccuracies in loading the small amounts of powder in the detonator shell or delay tube or capsule are common, and while a given deviation from the intended charge size or load in a given group of detonators may produce a variation from the assigned nominal delay times which is tolerable in higher-delay-period detonators, the variation produced by the same deviation in the lowest-delay-period detonators may be so great that the minimum amount of time does not elapse between the firing of detonators of any two consecutive periods. Delay detonators are needed whose delay interval is less sensitive to the small variations in delay charge size encountered in normal manufacturing processes, e.g., variations on the order of about ±0.03 gram.

In non-electric blasting systems, detonating cords are used to convey or conduct a detonation wave to an explosive charge in a borehole from a remote area. One type of detonating cord, known as low-energy detonating cord (LEDC), has an explosive core loading of only about 0.1 to 2 grams per meter of cord length. Such a cord is characterized by low brisance and the production of little noise, and therefore is particularly suited for use as a trunkline in cases where noise has to be kept to a minimum, and as a downline for the bottom-hole priming of an explosive charge.

In blasting practice, an LEDC downline may be joined to a delay detonator attached to the blasting explosive charge in a borehole. Detonation of the LEDC actuates the detonator, which in turn initiates the explosive charge. At the surface, a delay detonator may be interposed between two lengths of LEDC trunkline to provide a surface delay. Also, if the LEDC is of a type which is incapable of "picking up", i.e., detonating, from the detonation of a donor cord with which it is spliced or knotted, e.g., to connect downlines to a trunkline, a delay detonator may be interposed between the trunkline and downline to act as a delay "starter" for the downline.

The most desirable cord-initiated detonators are those which do not require connection to the cord at the place of manufacture. A field-assembled detonator/-cord system offers such advantages as safety and convenience during handling and storage, possible separate classificaton of the components for transportation, etc.

Co-pending U.S. patent application Ser. No. 177,210, which is a continuation-in-part of now-abandoned application Ser. No. 15,288, filed Feb. 26, 1979, describes a delay detonator adapted to be assembled in the field with a length of LEDC which is placed in coaxial position in an open cavity in the detonator, thereby making the detonator particularly useful as an in-hole delay initiator when connected to an LEDC downline.

U.S. Pat. No. 3,709,149 also describes a delay detonator adapted to be assembled in the field with a length of LEDC, which is disposed outside a closed shell that contains an impact-sensitive ignition composition held, for example, in an empty primed rim-fired or center-fired rifle cartridge casing used as an end closure for the detonator. The end or side of the cord is in direct and abutting contact with the exterior surface of the primer end, thereby permitting utilization of either the side or end output of the cord for ignition. This detonator generally is positioned in a booster unit embedded in an explosive charge in a borehole.

SUMMARY OF THE INVENTION

The present invention provides an improvement in a delay detonator adapted to be actuated electrically or by the percussive force applied to it by the detonation of an adjacent length of detonating cord, which detonator comprises a tubular metal detonator shell integrally closed at one end and closed at the other end by an ignition assembly for igniting a train of charges therein, and containing in sequence from its integrally closed end: (a) a base charge of a detonating explosive composition, e.g., pressed granular pentaerythritol tetranitrate (PETN); (b) a priming charge of a heat-sensitive detonating explosive composition, e.g., lead azide; and (c) a delay charge of an exothermic-burning composition. The improvement of the invention comprises a pressed delay charge separated from the ignition assembly by a loose pulverulent, flame-sensitive ignition charge having a free surface and adapted to be ignited in response to direct contact with flame emitted from the ignition of a charge in the ignition assembly.

In one embodiment, the detonator is non-electric and the ignition assembly which closes one end of the detonator shell comprises a partially empty tubular metal primer shell having an open end and supporting a percussion-sensitive primer charge adjacent the inside surface of an integrally closed end, the primer shell extending open end first into the detonator shell to dispose the primer charge end adjacent, and across, the end of the detonator shell. In this case, the loose ignition charge is adapted to be ignited by flame emitted from the ignition of the primer charge.

In an alternative embodiment, the detonator is electric and the ignition assembly comprises, for example, a heat-sensitive ignition composition having embedded therein a high-resistance bridge wire connected to a pair of leg wires having their ends firmly supported inside the detonator shell by a plug crimped in the end of the shell.

In a preferred embodiment, the delay charge is pressed into a plastic capsule which is nested within the detonator shell with an aperture-containing closed end resting against the priming charge, the loose ignition charge being held in a metal capsule which is nested within the delay-carrying plastic capsule and has an aperture-containing closed end resting against the delay charge. In the non-electric detonator, the plastic capsule preferably has an open end terminating between the walls of the detonator and primer shells.

BRIEF DESCRIPTION OF THE DRAWING

In the accompanying drawing, which illustrates various preferred embodiments of the detonator of the invention.

DETAILED DESCRIPTION

Figure 1:
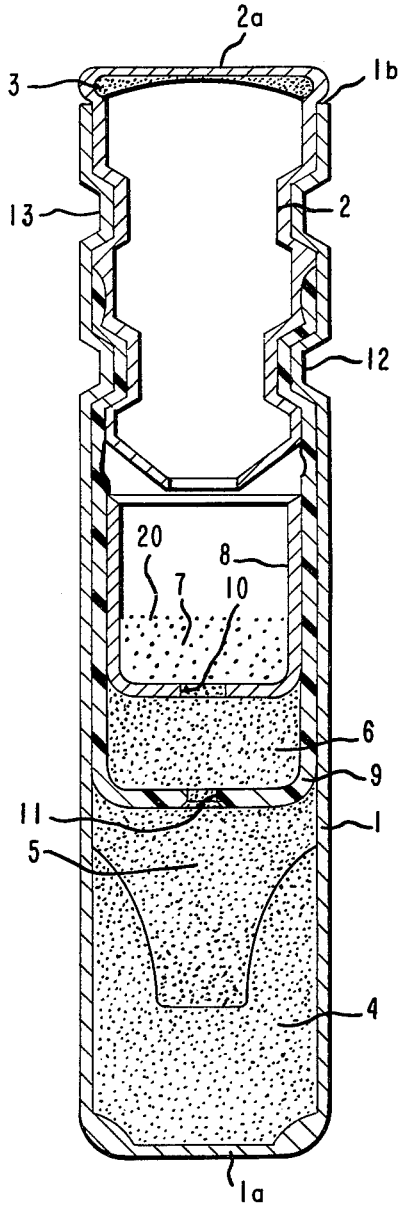
FIG. 1 is a longitudinal cross-sectional view of a percussion-actuated delay detonator of the invention.

Referring to FIG. 1, tubular metal detonator shell 1 is integrally closed at one end 1*a* and closed at the other end 1*b* by an ignition assembly comprising primer shell 2, in this case a rim-fired empty primed rifle cartridge casing. Shell 2 has an open end and an integrally closed end 2*a* which peripherally supports on its inner surface a percussion-sensitive primer charge 3 for rim-firing. Shell 2 extends open end first into shell 1 to dispose end 2*a* adjacent, and across, end 1*b* of shell 1.

Starting from end 1*a*, shell 1 contains four powder charges in the following sequence: base charge 4 of a pressed detonating explosive composition, e.g., pentaerythritol tetranitrate (PETN), cyclotrimethylenetrinitramine, cyclotetramethylenetetranitramine, lead azide, picryl sulfone, nitromannite, TNT, and the like; priming charge 5 of a pressed heat-sensitive detonating explosive composition; delay charge 6 of a pressed exothermic-burning composition; and a loose flame-sensitive ignition charge 7. Ignition charge 7, loosely loaded into metal capsule 8, has a free surface 20. Delay charge 6 is pressed into plastic capsule 9. Capsule 9 is nested within shell 1, and capsule 8 within capsule 9, and capsules 8 and 9 both have one open extremity and a closure at the other extremity provided with an axial orifice therethrough, i.e., orifices 10 and 11, respectively. The closure which contains orifice 10 is seated against delay charge 6, and that which contains orifice 11 against priming charge 5, charges 4, 5, and 6 being in a direct train along the detonator's longitudinal axis by virtue of orifice 11. Delay charge 6 can be any of the essentially gasless exothermic-reacting mixtures of solid oxidizing and reducing agents that burn at a constant rate and that are commonly used in ventless delay detonators. Examples of such mixtures are boron-red lead, boron-red lead-silicon, boron-red lead-dibasic lead phosphite, aluminum-cupric oxide, magnesium-barium peroxide-selenium, and silicon-red lead. Charge 6 is pressed into capsule 9 with a force of at least about 650, and preferably at least about 900, Newtons. Priming charge 5 is a heat-sensitive detonating explosive composition which is readily initiated by the burning of the delay composition, e.g., lead azide, mercury fulminate, diazodinitrophenol, or a similar composition.

A free space intervenes between ignition charge 7 and percussion-sensitive primer charge 3, thereby permitting the flame emitted from the ignition of charge 3 to directly contact charge 7 and ignite it and allow it to burn instantaneously. Typical of the compositions which can be used for charge 7 are flame-sensitive materials such as lead dinitro-o-cresylate, lead azide, and nitrocellulose, singly or in mixture with one another as well as with one or more oxidizers such as metal chlorates, nitrates, or oxides, especially red lead and potassium chlorate, or with one or more metal fuels such as boron, silicon, or magnesium; and mixtures of one or more of such metal fuels with one or more of the specified oxidizers.

Typical compositions for percussion-sensitive primer charge 3 are potassium chlorate, lead styphnate, mercury fulminate, antimony sulfide, lead azide, and tetracene, and mixtures of such compounds with each other or with metal oxides, materials such as sand, glass, and glue being added in certain instances. These compositions are well-known in the munitions art and often utilized as the "primer" charge in 0.22 caliber rifle cartridges.

In the percussion-actuated detonator shown in FIG. 1, plastic capsule 9 fits around the innermost portion of primer shell 2 so as to terminate and be sandwiched between the walls of shell 2 and shell 1 while allowing the wall portion of shell 2 adjacent to closed end 2*a* to remain in contact with the wall of shell 1. Circumferential crimp 12 jointly deforms the walls of shells 1 and 2 and capsule 9. Circumferential crimp 13 jointly deforms the walls of shells 1 and 2.

Figure 2:
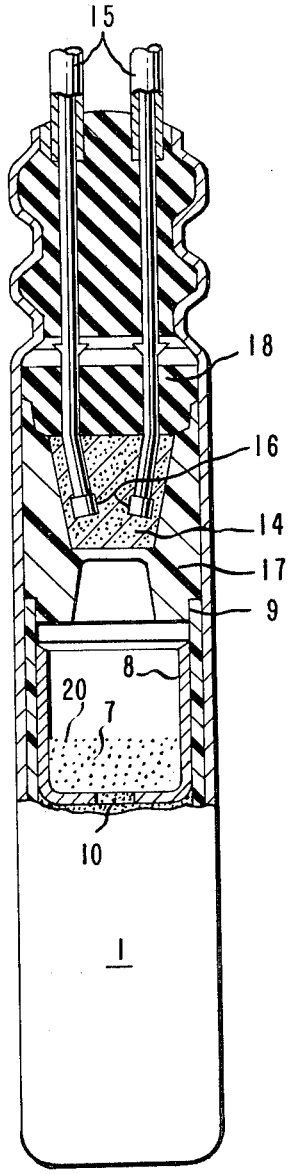
FIG. 2 is a longitudinal side view of an electric delay detonator of the invention, in which an electrical ignition assembly is shown in cross-section.

The electric detonator shown in FIG. 2 has an ignition assembly consisting of heat-sensitive ignition composition 14, a pair of leg wires 15, and a high-resistance bridge wire 16. Ignition composition 14 is seated within plastic ignition cup 17. Grooved rubber plug 18 is securely crimped in the open end of shell 1 over ignition composition 14, forming a water-resistant closure and firmly positioning the ends of leg wires 15 inside shell 1. Ignition cup 17 is seated onto plastic capsule 9. As an example, ignition cup 17 is made of polyethylene, ignition charge 14 is 0.27 gram of a 2/98 boron/red lead mixture, grained with polysulfide rubber, and plastic-insulated metal (copper or iron) leg wires 15 have bared ends connected to 0.04-mm-diameter, 1.00-ohm resistance bridge wire 16 embedded in ignition charge 14. The remainder of the detonator, i.e., parts designated 1, 4, 5, 6, 7, 8, 9, 10, and 11 are the same as those in the detonator shown in FIG. 1.

It has been found that the interposition of a small charge of loose ignition composition adjacent the delay charge and adapted to be ignited by direct contact with flame emitted from the ignition of a charge in the ignition assembly has the effect of increasing the burning rate of the delay charge so that the sensitivity of the detonator's delay interval to small variations in delay charge size or other internal conditions in the detonator are reduced, thereby lowering the time scatter of a group of detonators. As was stated previously, this is particularly important in short-delay detonators. The loose ignition powder has a free surface, i.e., a free space intervenes between this powder and the initiation charge in the ignition assembly. This lack of total restraint allows even conventional delay powders to burn so rapidly that they do not per se increase the delay interval of the detonator. On the contrary, a shorter delay results, an indication that the loose ignition charge may instantaneously raise the internal pressure and, in effect, increase the burning rate of the delay composition.

The amount of loose ignition charge required to produce the described advantageous effect on the burning rate of the delay charge depends on the chemical nature of the selected ignition composition. As a rule, organic compounnds such as lead dinitro-o-cresylate and nitrocellulose, and mixtures containing them, are used in smaller amounts than mixtures of metal fuels and oxides. For example, lead dinitro-o-cresylate is used in amounts of about from 0.01 to 0.06, and preferably 0.04 to 0.05, gram. With smokeless powder, or a 50/25/25 (parts by weight) mixture of lead dinitro-o-cresylate, smokeless powder, and potassium chlorate, as little as 0.003 gram can be used, up to a maximum of about 0.02 gram. On the other hand, with mixtures of boron and/or silicon with red lead, about from 0.02 to 0.65, preferably 0.32 to 0.45, gram should be used. Minimum amounts are associated with minimum available volumes. Exceeding the indicated maximum may result in overpressurization of the detonator, which could result in the ejection of the ignition assembly from the detonator shell, or perhaps rupturing of the shell itself.

The term "loose ignition charge" as used herein to describe the charge which separates the pressed delay charge from the percussion- or electrically-actuated ignition assembly denotes an ignition powder generally in the uncompacted form, or insufficiently compacted as to cause an addition in the delay time provided by the pressed delay charge. An uncompacted powder, e.g., a mass of powder which has a specific volume that is at least about 90% of the specific volume of the free-flowing powder, or which is pourable or fluid when shaken out of its container is preferred. However, although compaction or pressing of the loose ignition charge is neither necessary nor preferred, gas-producing organic ignition compositions such as lead dinitro-o-cresylate produce about the same effect on delay timing when pressed at about 200–400 Newtons as when unpressed, and therefore, in these cases the "loose ignition charge" may have been lightly pressed (up to about 400 N). Gasless compositions such as boron and/or silicon and red lead mixtures, however, should be used in the unpressed form inasmuch as they increase the delay time significantly when pressed at 200 Newtons.

The improvement in uniformity of delay timing achieved with the present detonator is shown by the following examples.

EXAMPLE 1

The detonator shown in FIG. 1 was made. Shell 1, made of Type 5052 aluminum alloy, was 44.5 mm long, and had an internal diameter of 6.5 mm and a wall thickness of 0.4 mm. Capsule 9 was made of high-density polyethylene, was 21.6 mm long, and had an outer diameter of 6.5 mm and an internal diameter of 5.6 mm. Axial orifice 11 was 1.3 mm in diameter. Capsule 8, made of Type 5052 aluminum alloy, was 11.9 mm long, and had an outer diameter of 5.6 mm and a wall thickness of 0.5 mm. Axial orifice 10 was 2.8 mm in diameter. Base charge 4 consisted of 0.51 gram of PETN, which had been placed in shell 1 and pressed therein at 1300 Newtons with a pointed press pin. Priming charge 5 was 0.17 gram of lead azide. Capsule 9 was placed next to charge 5 and pressed at 1300 Newtons with an axially tipped pin shaped to prevent the entrance of charge 5 into capsule 9 through orifice 11. Delay charge 6, which was loosely loaded into capsule 9, was a 2.5/97.5/20 (parts by weight) mixture of boron, red lead, and silicon. Capsule 8 was seated in capsule 9 at 1300 Newtons. Lead dinitro-o-cresylate was loosely loaded into capsule 8. Shell 2 and charge 3 constituted a 0.22-caliber rim-fired empty primed rifle cartridge casing. The free volume between charges 7 and 3 was 600 cu mm. Crimps 12 and 13 were 5.3 mm in diameter. The detonator was actuated by the detonation of a low-energy detonating cord transversely positioned in contact with the outside surface of end 2*a* of the primed rifle cartridge casing. The cord was the one described in Example 1 of U.S. Pat. No. 4,232,606.

The following table shows the delay timing results obtained with the described detonator with changing delay loadings, when three different loose ignition charge loadings, and no loose ignition charge, were present.

| Lead Salt*** (grams) | Delay Charge (grams) 0.19 T* | 0.19 S** | 0.23 T | 0.23 S | 0.26 T | 0.26 S | 0.30 T | 0.30 S |
|---|---|---|---|---|---|---|---|---|
| 0 | 26 | 3.2 | 30 | 2.5 | 32 | 4 | 34 | 4.3 |
| 0.04 | 16 | 1.3 | 18 | 0.7 | 20 | 0.3 | 20 | 1.3 |
| 0.05 | 15 | 1.1 | 17 | 0.6 | 18 | 0.8 | 19 | 0.8 |
| 0.06 | 14 | 0.9 | 17 | 0.8 | — | — | 19 | 1.3 |

*Average delay time for 10 detonators (ms)
**Standard deviation; scatter from average (ms)
***Lead dinitro-o-cresylate (loose ignition charge)

The above results show that the delay interval, i.e., the time between the application of the percussive energy and the detonation of the detonator, was shorter when the loose lead salt was added above the delay charge as described than when the lead salt was absent, a condition observed with the same delay composition in each of four different loadings. Thus, a shorter delay interval resulted despite the fact that more powder burned when the lead salt was present. However, the striking features of the above results are the greatly reduced S (scatter) obtained with the detonators which contained the loose lead salt, and the decreased sensitivity of T to changes in the amount of delay charge obtained with those detonators. For example, an increase in delay charge weight from 0.19 to 0.30 gram (a difference of 0.11 gram) produced an 8 ms increase in the delay time in the detonator containing no loose lead salt, whereas the same increase in delay charge weight increased the delay time only 4 or 5 ms when the loose lead salt was present. Also, in the detonator of this invention, the timing was increased by only 2 ms when the weight of delay charge increased from 0.23 to 0.30 gram, whereas a 4 ms increase was observed with the detonator which contained no loose lead salt.

EXAMPLE 2

The procedure of Example 1 was repeated with the exception that the lead salt was replaced by 0.01 gram of smokeless powder. The weight of pressed delay charge was 0.26 gram. The average delay time was 18.5 ms and the standard deviation 0.9 ms. The same procedure except with replacement of the lead salt with 0.02 gram of a 50/25/25 (parts by weight) mixture of lead salt/smokeless powder/potassium chlorate resulted in a 19.0 ms average delay time and an 0.8 ms standard deviation.

EXAMPLE 3

The procedure of Example 2 was repeated with the exception that the same composition used in the pressed form as the delay charge was loosely loaded into capsule 8 so as to constitute the ignition charge. Average delay times and standard deviations were 29 and 2.5 ms, 27 and 1.0 ms, 26 and 1.5 ms, and 25 and 1.3 ms for 0.07, 0.10, 0.13, and 0.16 gram ignition charges, respectively.

EXAMPLE 4

The procedure of Example 1 was repeated except that the electrical ignition assembly shown in FIG. 2 was used to ignite loose ignition charge 7. Components of the ignition assembly were polyethylene ignition cup 17, heat-sensitive ignition charge 14, in this case 0.27 gram of a 2/98 boron/red lead mixture, grained with polysulfide rubber, and plastic-insulated copper leg wires 15 having bared ends connected to 0.04-mm-diameter, 1.00-ohm resistance bridge wire 16 embedded in the ignition charge. Ignition cup 17 was seated onto capsule 9, which ws 9.4 mm long. Delay charge 6 was 0.52 gram of a mixture of boron and red lead, grained with polysulfide rubber, the boron content being 1.7% by weight. Capsule 8, which was seated in capsule 9 at 1300 Newtons, contained 0.19 gram of the same loose ignition charge 7 used in Example 3. The average delay time for 10 of these detonators was 74.3 ms. The standard deviation was 1.7 ms.

Ten of the same electrical detonators which had no loose ignition charge in capsule 8 had an average delay time of 81.4 ms, with a standard deviation of 4.2 ms.

In the percussion-actuated detonator, the use of a plastic tubular member between a portion of the facing surfaces of the detonator and primer shells with a circumferential crimp through the three-layered metal-plastic-metal portion and a circumferential crimp through the two-layered metal-metal portion is a preferred embodiment of this invention. This feature contributes greatly to the non-venting characteristic of the present non-electric detonator, a characteristic which is important in achieving accurate timing. The plastic tubular member can be made of any thin thermoplastic material such as nylon or a polyolefin, or a thermosetting or elastomeric material.

In a preferred embodiment, the delay charge is pressed into a polyolefin or polyfluorocarbon carrier tubular member, i.e., a capsule or tube, as is described in the aforementioned co-pending U.S. patent application Ser. No. 77,718, the disclosure of which is incorporated herein by reference. As is stated therein, this plastic carrier tube or capsule for the delay charge reduces the variability of the timing with changes in the surrounding temperature or medium. In the non-electric detonator, it is convenient to use a delay carrier tube or capsule, e.g., capsule 9 in the drawing, having an open end which fits around the innermost portion of the primer shell so as to terminate and be sandwiched between the walls of the detonator shell and primer shell while allowing the wall portion of the primer shell adjacent to its closed end to remain in contact with the wall of the detonator shell. In this manner, one component provides the desired sealing between the detonator and primer shells, and also insulating of the pressed delay charge.

However, included within the scope of this invention are detonators having the delay charge and/or the loose ignition charge loaded directly into the detonator shell without special carrier tubes or capsules. Also, the loose ignition charge can be loaded into the same metal or plastic carrier tube or capsule used for the delay charge. Alternatively, the delay charge can be loaded directly into the detonator shell, and the loose ignition charge into a metal or plastic tube or capsule above the delay charge. In one embodiment of this type, the ignition charge in a non-electric detonator is in a plastic capsule that is seated over the carrierless delay charge and that terminates between the detonator and primer shells. In another embodiment, a plastic ignition-charge carrier is seated against a thick-walled metal carrier for the delay charge. All metal or plastic layers, e.g., closures on carrier capsules, separating the delay charge from the loose ignition charge and from the priming charge preferably have an axial orifice therethrough to provide an uninterrupted reaction train. However, such an orifice is unnecessary if the closed capsule end can be perforated by the burning of the charge therein without significantly changing the burning time of the reaction train.

The percussion actuation feature of the non-electric detonator depends on the closing of the actuation end of the detonator with a metal shell whose closed end supports on its inner surface a percussion-sensitive primer charge arranged to be ignited along its rim or at its center. Conventional center- or rim-fired ammunition primers can be used.

The detonator of this invention can be used as an in-hole delay initiator for an explosive charge in a borehole. Furthermore, the non-electric detonator can be used as a surface delay between two lengths of trunkline cords, or between a trunkline cord and a downline cord; or as a delay starter for a relatively insensitive downline cord. The non-electric detonator is actuated by the percussive force applied to it by the detonation of an adjacent length of low-energy detonating cord axially or transversely arrayed adjacent to the actuation end of the detonator. In cord-to-cord assemblies, the base-charge end of the detonator is arrayed adjacent to a length of low-energy or high-energy detonating cord. An assembly of donor and receiver detonating cords connected via a percussion-actuated detonator such as the detonator of this invention is described in co-pending U.S. patent application Ser. No. 06/257,973, filed on even date herewith.

I claim:

1. A delay detonator comprising a tubular metal detonator shell integrally closed at one end and closed at the other end by an ignition assembly for igniting a train of charges therein, and containing, in sequence from its integrally closed end, (a) base charge of a detonating explosive composition;

(b) a priming charge of a heat-sensitive detonating explosive composition;

(c) a pressed delay charge of an exothermic-burning composition; and (d) a loose pulverulent, flame-sensitive ignition charge separating said delay charge from said ignition assembly, said loose ignition charge (1) having a free surface adapting it to be unrestrained in the direction of said ignition assembly and (2) being adapted to be ignited in response to direct contact with flame emitted from the ignition of a charge in said ignition assembly.

2. A delay detonator of claim 1 adapted to be actuated by the percussive force applied to it by the detonation of an adjacent length of detonating cord, wherein said ignition assembly comprises a partially empty, tubular metal primer shell having an open end and supporting a percussion-sensitive primer charge adjacent the inside surface of an integrally closed end, said primer shell extending open end first into said detonator shell to dispose said primer charge end adjacent, and across, the end of said detonator shell, said loose ignition charge being adapted to be ignited by flame emitted from the ignition of said primer charge.

3. A detonator of claim 2 wherein a plastic tubular member fits around a portion of said primer shell so as to be sandwiched between the walls of said detonator shell and said primer shell while allowing a portion of said primer shell to remain in contact with the wall of said detonator shell, said detonator being provided with a first circumferential crimp which jointly deforms said detonator shell wall, the wall of said plastic tubular member, and the wall of said primer shell, and a second circumferential crimp which jointly deforms the walls of said detonator and primer shells.

4. A delay detonator of claim 1 wherein said ignition assembly comprises a heat-sensitive ignition composition having embedded therein a high-resistance bridge wire connected to a pair of leg wires having their ends supported inside said detonator shell by a plug crimped into the end of said shell.

5. A detonator of claim 1 wherein said delay charge is pressed into a plastic tubular member which is nested within said detonator shell.

6. A detonator of claim 5 wherein said plastic tubular member is a capsule having one open extremity and a closure at the other extremity provided with an axial orifice therethrough, said closure being seated against said priming charge.

7. A detonator of claim 5 wherein said loose ignition charge is present in a metal capsule having one open extremity and a closure at the other extremity provided with an axial orifice therethrough, said metal capsule being nested within said plastic tubular member with its closure seated against said delay charge.

8. A detonator of claim 5, 6, or 7 wherein said ignition assembly comprises a partially empty, tubular metal primer shell having an open end and supporting a percussion-sensitive primer charge adjacent the inside surface of an integrally closed end, said primer shell extending open end first into said detonator shell to dispose said primer charge end adjacent, and across, the end of said detonator shell, said loose ignition charge being adapted to be ignited by flame emitted from the ignition of said primer charge, and said plastic tubular member fits around the innermost portion of said primer shell so as to terminate and be sandwiched between the walls of said detonator shell and said primer shell while allowing the wall portion of said primer shell adjacent its closed end to remain in contact with the wall of said detonator shell, said detonator being provided with a first circumferential crimp which jointly deforms said detonator shell wall, the wall of said plastic tubular member, and the wall of said primer shell, and a second circumferential crimp which jointly deforms the walls of said detonator and primer shells.

9. A detonator of claim 5 wherein said plastic tubular member is made of a polyolefin or a polyfluorocarbon.

10. A detonator of claim 1 wherein said loose ignition charge is present in a capsule having one open extremity and a closure at the other extremity provided with an axial orifice therethrough, the closure on said capsule being seated against said delay charge or a carrier for said delay charge.

11. A detonator of claim 10 wherein said capsule is made of plastic.

12. A detonator of claim 11 wherein said ignition assembly comprises a partially empty, tubular metal primer shell having an open end and supporting a percussion-sensitive primer charge adjacent the inside surface of an integrally closed end, said primer shell extending open end first into said detonator shell to dispose said primer charge end adjacent, and across, the end of said detonator shell, said loose ignition charge being adapted to be ignited by flame emitted from the ignition of said primer charge.

13. A detonator of claim 2 wherein said delay charge is pressed into an axial perforation in a thick-walled metal carrier seated against said priming charge.

14. A detonator of claim 1 wherein said loose ignition charge comprises at least one powder selected from the group consisting of lead dinitro-o-cresylate and smokeless powder, and mixtures thereof with at least one oxidizer and/or at least one fuel.

15. A detonator of claim 14 wherein said loose ignition charge is present in the amount of about from 0.0003 to 0.06 gram.

16. A detonator of claim 1 wherein said loose ignition charge comprises at least one metal fuel and at least one metal oxide.

17. A detonator of claim 16 wherein said loose ignition charge is present in the amount of about from 0.02 to 0.65 gram.

18. A detonator of claim 16 wherein said loose ignition charge is a mixture of boron, red lead, and silicon.

* * * * *

UNITED STATES PATENT AND TRADEMARK OFFICE

CERTIFICATE OF CORRECTION

PATENT NO. : 4,429,632

DATED : February 7, 1984

INVENTOR(S) : Malak E. Yunan

It is certified that error appears in the above—identified patent and that said Letters Patent is hereby corrected as shown below:

Claim 15, line 3: change "0.0003" to -- 0.003 --.

Signed and Sealed this

*Twenty-fourth* Day of *April 1984*

[SEAL]

*Attest:*

GERALD J. MOSSINGHOFF

*Attesting Officer*

*Commissioner of Patents and Trademarks*